US009857034B2

(12) United States Patent
Aslanov et al.

(10) Patent No.: US 9,857,034 B2
(45) Date of Patent: Jan. 2, 2018

(54) ULTRA SLIM COLLIMATOR FOR LIGHT EMITTING DIODE

(75) Inventors: Emil Aslanov, Moscow (RU); Nikolay Petrov, Moscow (RU); Alexey Borodulin, Moscow (RU); Georgy Tananaev, Moscow (RU); Seokhoon Kang, Seongnam-si (KR)

(73) Assignee: LG ELECTRONICS INC., Seoul (KR)

( * ) Notice: Subject to any disclaimer, the term of this patent is extended or adjusted under 35 U.S.C. 154(b) by 258 days.

(21) Appl. No.: 14/347,787

(22) PCT Filed: Oct. 27, 2011

(86) PCT No.: PCT/KR2011/008083

§ 371 (c)(1),
(2), (4) Date: Mar. 27, 2014

(87) PCT Pub. No.: WO2013/062159

PCT Pub. Date: May 2, 2013

(65) Prior Publication Data

US 2014/0240991 A1 Aug. 28, 2014

(51) Int. Cl.
*F21V 7/00* (2006.01)
*F21K 99/00* (2016.01)
(Continued)

(52) U.S. Cl.
CPC ..... *F21K 9/50* (2013.01); *F21K 9/60* (2016.08); *F21V 7/0016* (2013.01);
(Continued)

(58) Field of Classification Search
CPC ... F21K 9/50; F21V 13/04; F21V 5/04; F21V 7/04; F21V 7/0008; F21V 7/0033; F21Y 2101/02
(Continued)

(56) References Cited

U.S. PATENT DOCUMENTS 4,037,096 A * 7/1977 Brendgord ..... F21V 7/0008 362/294
6,473,554 B1 * 10/2002 Pelka ..... G02B 6/0018 385/146
(Continued)

FOREIGN PATENT DOCUMENTS

JP 2003-114432 A 6/2006
JP 2009-259448 A 11/2009
(Continued)

*Primary Examiner* — Tsion Tumebo
(74) *Attorney, Agent, or Firm* — Birch, Stewart, Kolasch & Birch, LLP

(57) ABSTRACT

Systems and devices for collimating beams of light emitted by a light emitting diode are disclosed. In one embodiment, an optical device comprises a bowl shaped reflector base, a light emitting diode (LED) physically attached to the bowl shaped reflector base, a central reflector in a shape of a hyperbolic cone formed above the LED about a center of the bowl shaped reflector base, and a transparent plate formed around a base of the hyperbolic cone. In the embodiment, the central reflector in the shape of the hyperbolic cone is configured to reflect a portion of light emitted from the LED to an outer edge of the bowl shaped reflector base which in turn substantially reflect the portion of light via the transparent plate almost parallel to an optical axis of the LED.

4 Claims, 4 Drawing Sheets

(51) Int. Cl.

| | |
|---|---|
| ***F21V 13/04*** | (2006.01) |
| ***F21K 9/60*** | (2016.01) |
| *F21V 7/08* | (2006.01) |
| *F21Y 115/10* | (2016.01) |

(52) U.S. Cl.
CPC ..... *F21V 7/0033* (2013.01); *F21V 13/04* (2013.01); *F21V 7/08* (2013.01); *F21Y 2115/10* (2016.08)

(58) Field of Classification Search
USPC ..... 362/299, 300
See application file for complete search history.

(56) References Cited

U.S. PATENT DOCUMENTS 6,558,032 B2 * 5/2003 Kondo ..... F21S 48/1388 362/303
6,641,287 B2 * 11/2003 Suehiro ..... G02B 19/0061 257/94
6,840,652 B1 * 1/2005 Hymer ..... F21S 48/215 362/235
7,246,921 B2 * 7/2007 Jacobson ..... F21K 9/00 257/E33.072
8,220,975 B2 * 7/2012 Miyashita ..... F21V 5/04 359/642
8,684,584 B2 * 4/2014 Inditsky ..... G02F 1/133606 362/561
2003/0189832 A1 * 10/2003 Rizkin ..... F21V 5/046 362/302
2004/0246697 A1 12/2004 Yamashita et al.
2006/0077667 A1 * 4/2006 Lui ..... F21V 5/006 362/300
2007/0297179 A1 * 12/2007 Leung ..... F21V 7/0008 362/296.07
2009/0290349 A1 * 11/2009 Chu ..... F21S 48/328 362/249.02
2010/0220484 A1 * 9/2010 Shani ..... G02B 5/021 362/296.09
2010/0264797 A1 * 10/2010 Wang ..... F21V 7/0008 313/46
2012/0087133 A1 * 4/2012 Markytan ..... F21K 9/00 362/308

FOREIGN PATENT DOCUMENTS

JP 2009-259449 A 11/2009
KR 10-2006-0071033 A 6/2006

* cited by examiner

[Fig. 1]
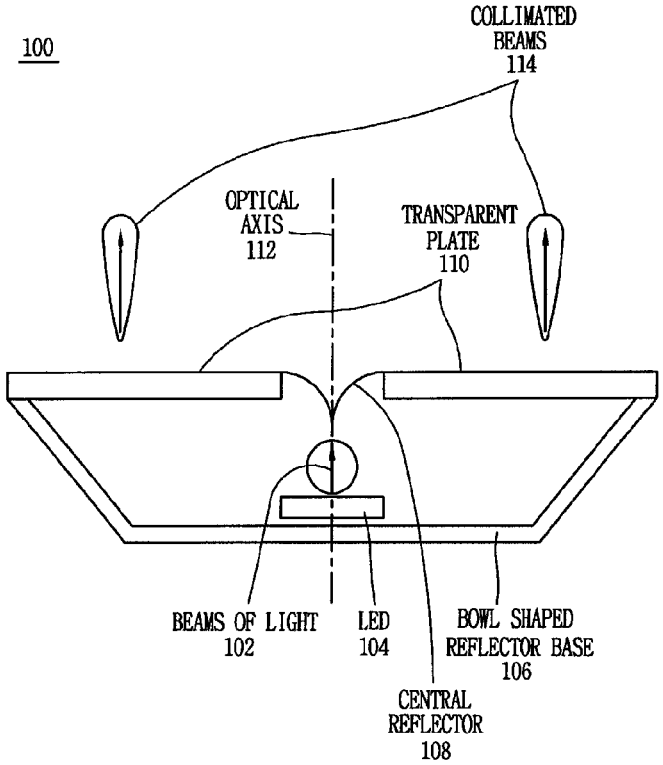
[Fig. 2]
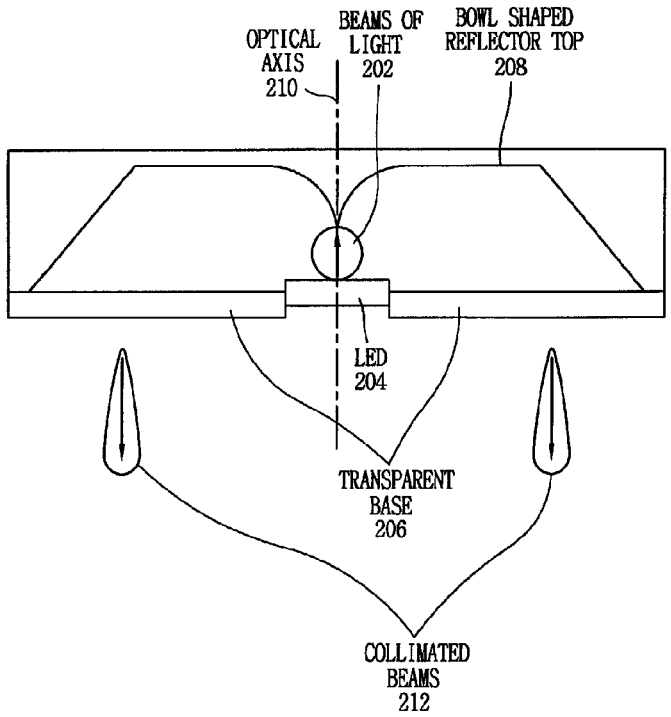

[Fig. 3]
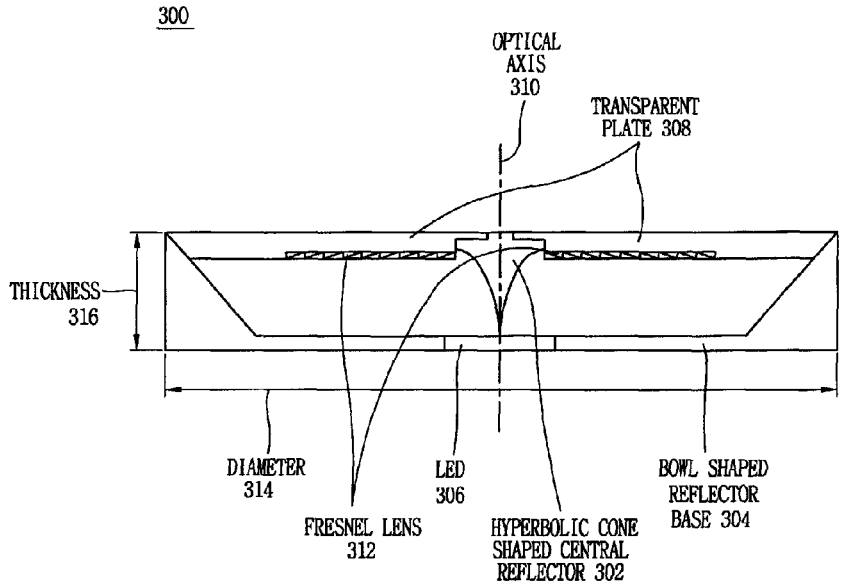
[Fig. 4a]
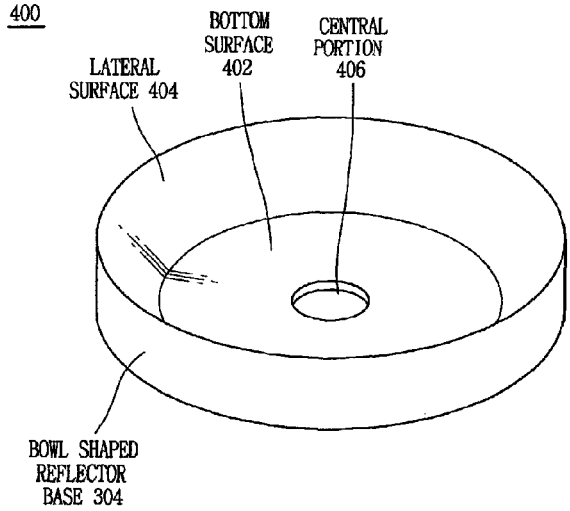
[Fig. 4b]
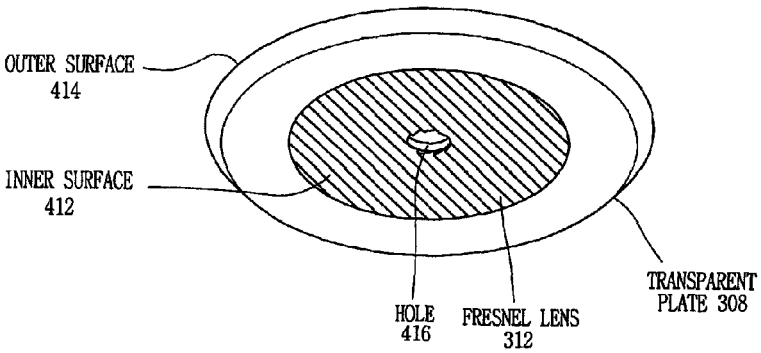

[Fig. 4c]
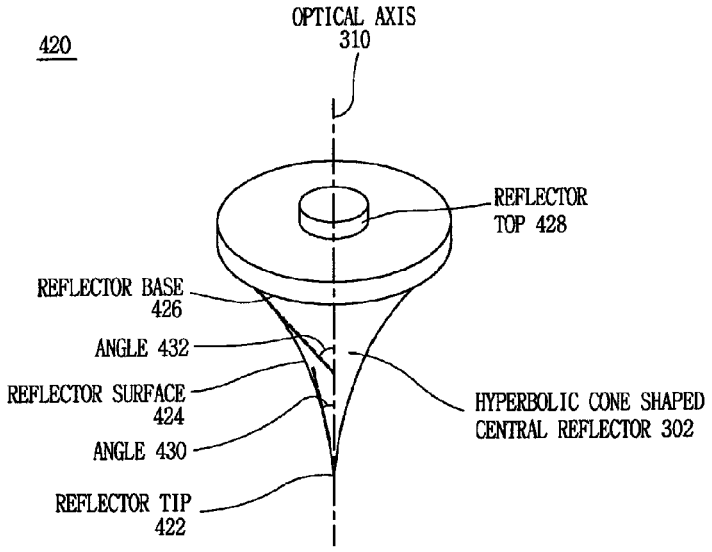
[Fig. 5a]
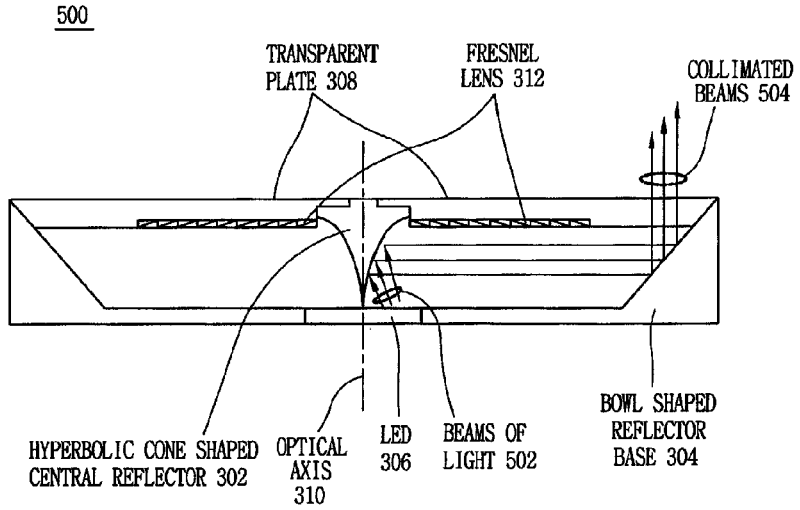
[Fig. 5b]
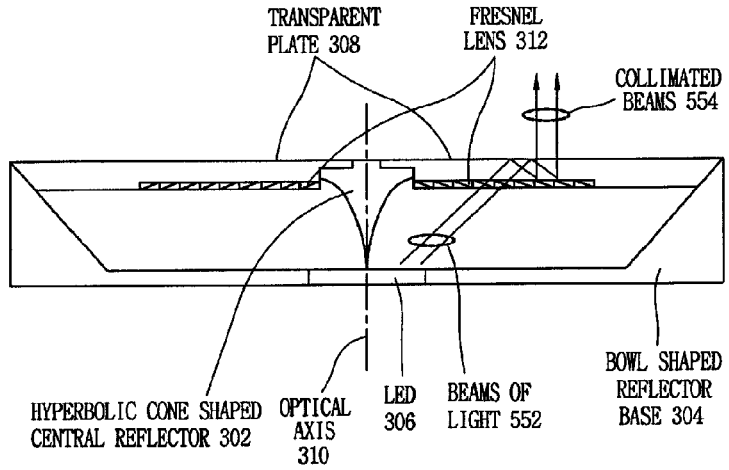

[Fig. 6a]
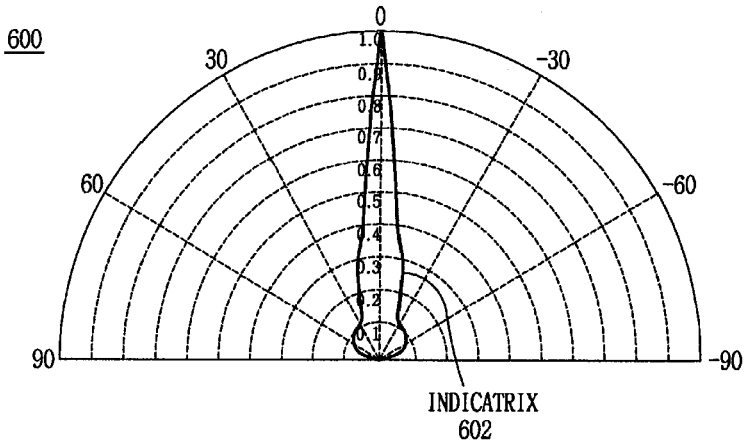
[Fig. 6b]
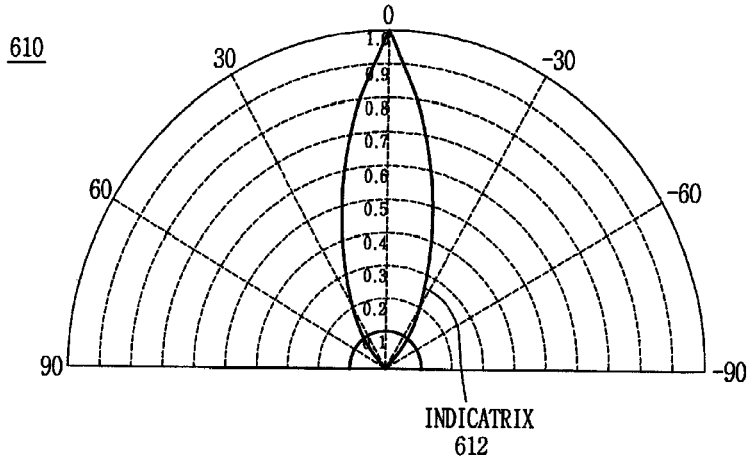
[Fig. 6c]
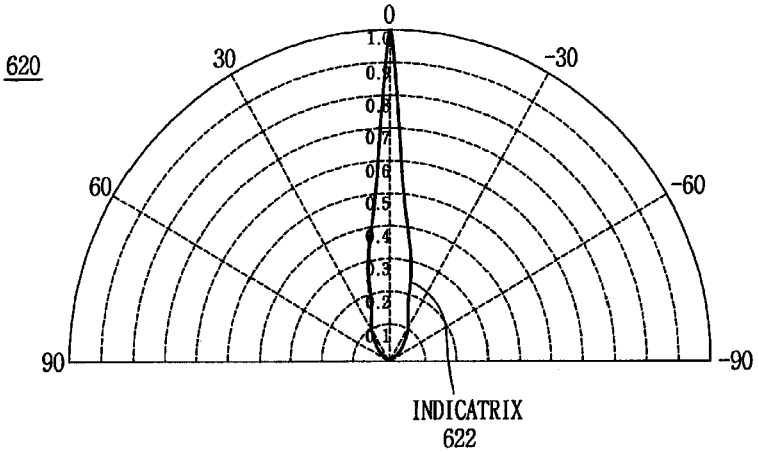

ULTRA SLIM COLLIMATOR FOR LIGHT EMITTING DIODE

TECHNICAL FIELD

Embodiments of the disclosure generally relate to the field of electronics, and more particularly to optical systems and devices.

BACKGROUND ART

A light emitting diode (LED) is a semiconductor light source which is often used as an indicator lamp. Early LEDs emitted low-intensity red light, but modern versions are available across the visible, ultraviolet and infrared wavelengths, with very high brightness. An LED is often small in area (e.g., less than 1 square millimeter), and an optical device usually comprises the LED as a lighting source and integrated optical components to shape its radiation patterns.

As for the optical device, the LED as a form of a chip is often secured onto a substrate and positioned in the recess of a bowl-shaped collimator lens. The lens is rotationally symmetrical in shape and has an associated axis of symmetry. The position of the LED and the shape of the lens are attuned to each other in such a manner that a large part of the light generated by the LED is converted through refraction and reflection into a parallel light beam which leaves the lens.

DISCLOSURE OF INVENTION

Solution to Problem

Systems and devices for collimating beams of light emitted by a light emitting diode are disclosed. In one aspect, an optical device comprises a bowl shaped reflector base, a light emitting diode (LED) physically attached to the bowl shaped reflector base, a central reflector in a shape of a hyperbolic cone formed above the LED about a center of the bowl shaped reflector base, and a transparent plate formed around a base of the hyperbolic cone. In the aspect, the central reflector in the shape of the hyperbolic cone is configured to reflect a portion of light emitted from the LED to an outer edge of the bowl shaped reflector base which in turn substantially reflects the portion of light via the transparent plate almost parallel to an optical axis of the LED.

In another aspect, an optical device comprises a light emitting diode (LED), a transparent base physically attached to the LED, and a bowl shaped reflector top, wherein the bowl shaped reflector top is configured to reflect light emitted from the LED via the transparent base almost parallel to an optical axis of the LED.

Other features of the embodiments will be apparent from the accompanying drawings and from the detailed description that follows.

BRIEF DESCRIPTION OF DRAWINGS

Example embodiments are illustrated by way of example and not limitation in the figures of the accompanying drawings, in which like references indicate similar elements and in which:

FIG. 1 illustrates an exemplary optical device for collimating beams of light emitted by an LED, according to one embodiment.

FIG. 2 illustrates another exemplary optical device for collimating beams of light emitted by an LED, according to one embodiment.

FIG. 3 illustrates an exemplary optical device with a hyperbolic cone shaped central reflector, according to one embodiment.

FIG. 4*a* illustrates an exemplary three dimensional view of the bowl shaped reflector base in FIG. 3, according to one embodiment.

FIG. 4*b* illustrates an exemplary three dimensional view of the transparent plate in FIG. 3, according to one embodiment.

FIG. 4*c* illustrates an exemplary three dimensional view of the bowl shaped reflector base in FIG. 3, according to one embodiment.

FIGS. 5*a* and 5*b* illustrate exemplary paths of beams collimated by the optical device of FIG. 3, according to one embodiment.

FIG. 6*a* illustrates an exemplary indicatrix of the collimated beams in FIG. 5*a*.

FIG. 6*b* illustrates an exemplary indicatrix of the collimated beams in FIG. 5*b*.

FIG. 6*c* illustrates an exemplary indicatrix of the beams collimated by the optical device in FIG. 3.

Other features of the present embodiments will be apparent from the accompanying drawings and from the detailed description that follows. Further, the drawings described herein are for illustration purposes only and are not intended to limit the scope of the present disclosure in any way.

MODE FOR THE INVENTION

Systems and devices for collimating beams of light emitted by a light emitting diode are disclosed. In general, an irradiation angle of LED light is great, and thus LED based optical devices have been mainly used to illuminate a broad region or a region in close distance. Thus, when an LED based optical device is used to illuminate a local region in somewhat long distance, a focusing lens to focus or collimate the light emitted by the LED based optical device is often used. That is, it is often the case that the LED based optical device is made of a light source (e.g., an LED), a reflector base, and a transparent plate configured to collimate the rays that pass through it.

In the conventional optical device or system, the thickness of the reflector base has been kept relatively long to reduce the diversion angle of the light that passes through the transparent plate. That is, in order to prevent or reduce the light emitted from the LED from dispersing at a wide angle, the thickness of the reflector base was configured to prolong the distance traveled by the light at a certain distance from the light source so that the light that is illuminated through the transparent plate is collimated and substantially parallel with the axis of the LED based optical device. However, the prolonging of the light path has led to the increase of the thickness in the LED based optical device, thus resulting in the enlargement of the overall size of the optical device. Thus, it is a problem to achieve a slim design of optics (e.g., thickness less than 10 millimeters) to collimate light beams up to 25 degrees at the half energy level with efficiency of more than 90 percent if conventional techniques were used. This task becomes even more difficult for an optical device with its diameter more than 10 millimeters, but nowadays the market requires an ultra slim solution for powerful LEDs with a large emitting area.

To solve the problem, according to the first embodiment of the present disclosure, an optical device (e.g., a LED based optical device, etc.) comprises a bowl shaped reflector base, a light emitting diode (LED) physically attached to the bowl shaped reflector base, a central reflector in a shape of a hyperbolic cone formed above the LED about a center of the bowl shaped reflector base, and a transparent plate formed around a base of the hyperbolic cone. In the embodiment, the central reflector in the shape of the hyperbolic cone is configured to effectively reflect a large portion of light emitted from the LED to an outer edge of the bowl shaped reflector base which in turn substantially reflect the portion of light via the transparent plate almost parallel to an optical axis of the LED. By doing so, the optical device can remain ultra slim while maintaining a relatively wide diameter.

According to the second embodiment of the present disclosure, an optical device comprises a light emitting diode (LED), a transparent base physically attached to the LED, and a bowl shaped reflector top, wherein the bowl shaped reflector top is configured to reflect light emitted from the LED via the transparent base almost parallel to an optical axis of the LED. In one exemplary embodiment, the bowl shaped reflector top comprises a hyperbolic cone shaped reflector at its center, where the hyperbolic cone shaped reflector is configured to effectively reflect a large portion of the beams of light emitted by the LED toward the outer edge of the bowl shaped reflector top, which in turn reflect the beams of lights toward the transparent base. The working of the optical device in the second embodiment is almost same as that of the first embodiment, except that the collimated beams are illuminated in a forward direction in the perspective of the LED in the first embodiment, whereas the collimated beams are illuminated in a reverse direction in the perspective of the LED in the second embodiment.

Accordingly, in both of the embodiments, by effectively spreading the beams of light illuminated by the LED toward the edge of the optical device through using the hyperbolic cone shaped reflector, the optical device can reduce its thickness while maintaining its width while affording highly intense collimated beams of light in an efficient manner.

Reference will now be made in detail to the embodiments of the invention, examples of which are illustrated in the accompanying drawings. While the invention will be described in conjunction with the embodiments, it will be understood that they are not intended to limit the invention to these embodiments. On the contrary, the disclosure is intended to cover alternatives, modifications and equivalents, which may be included within the spirit and scope of the invention. Furthermore, in the detailed description, numerous specific details are set forth in order to provide a thorough understanding of the present disclosure. However, it will be obvious to one of ordinary skill in the art that the present disclosure may be practiced without these specific details. In other instances, well known methods, procedures, components, and circuits have not been described in detail as not to unnecessarily obscure aspects of the present invention.

FIG. 1 illustrates an exemplary optical device 100 for collimating beams of light 102 emitted by an LED 104, according to one embodiment. In FIG. 1, the optical device 100 comprises a bowl shaped reflector base 106, the LED 104 physically attached to the bowl shaped reflector base 106, a central reflector 108 in a shape of a hyperbolic cone formed above the LED 104 about a center of the bowl shaped reflector base 106, and a transparent plate 110 formed around a base of the hyperbolic cone. In one embodiment, the central reflector 108 in the shape of the hyperbolic cone is configured to reflect a portion of light emitted from the LED 104 to an outer edge of the bowl shaped reflector base 106 which in turn substantially reflects the portion of light via the transparent plate 110 almost parallel to an optical axis 112 of the LED 104 as collimated beams 114. It is appreciated that collimated beams 114 are light whose rays are parallel, and therefore will spread slowly as it propagates. The word "collimated" is related to "collinear" and implies that light will disperse minimally.

In one exemplary implementation, the LED 104 is an LED chip. In one exemplary implementation, the LED 104 is formed on top of the bowl shaped reflector base 106. In another exemplary implementation, the LED 104 is formed in a hole which is formed at the center of the bowl shaped reflector base 106. In one exemplary implementation, the bowl shaped reflector base 106 and the central reflector 108 are made of a material that reflects light efficiently and/or essentially work as mirrors. In one exemplary implementation, a shape of the central reflector 108 is configured such that the beams of light 102 are collimated over a wide cross section in a short distance away from the light source, i.e., the LED 104. In one exemplary implementation, a diameter of the optical device 100 is more than 10 millimeters (e.g., about 20 millimeters) and a thickness of the optical device 100 is about or less than 5 millimeters. In one exemplary implementation, the transparent plate 110 comprises a Fresnel lens. It is appreciated that compared to conventional bulky lenses, the Fresnel lens is much thinner, larger, and flatter, and captures more oblique light from a light source. The Fresnel lens may be regarded as an array of prisms arranged in a circular fashion, with steeper prisms on the edges and a nearly flat convex center.

FIG. 2 illustrates another exemplary optical device 200 for collimating beams of light 202 emitted by an LED 204, according to one embodiment. In FIG. 2, the optical device 200 comprises the LED 204, a transparent base 206 physically attached to the LED 204, and a bowl shaped reflector top 208. Although it is not shown, in one exemplary implementation, the LED 204 is formed on top of the transparent base 206. In another exemplary implementation, as illustrated in FIG. 2, the LED 204 is formed in a hole which is formed at the center of the transparent base 206. The bowl shaped reflector top 208 is configured to reflect the beams of light 202 emitted from the LED 204 via the transparent base 206 almost parallel to an optical axis 210 of the LED 204 as collimated beams 212. In one embodiment, the central part of the bowl shaped reflector top 208 is in a shape of a hyperbolic cone which is configured to reflect a portion of the beams of light 202 emitted from the LED 204 to an outer edge of the bowl shaped reflector top 208 which in turn substantially reflects the portion of light via the transparent base 206 almost parallel to the optical axis 210 of the LED 204 as parts of the collimated beams 212.

In one exemplary implementation, the LED 204 is an LED chip. In one exemplary implementation, the bowl shaped reflector top 208 is made of a material that reflects light efficiently and/or essentially works as a mirror. In one exemplary implementation, the shape of the central portion of the bowl shaped reflector top 208 is configured such that the beams of light 202 are collimated over a wide cross section in a short distance away from the light source, i.e., the LED 204. In one exemplary implementation, a diameter of the optical device 200 is more than 10 millimeters (e.g., about 20 millimeters) and a thickness of the optical device 200 is about or less than 5 millimeters. In one exemplary implementation, the transparent base 206 comprises a Fresnel lens.

FIG. 3 illustrates an exemplary optical device 300 with a hyperbolic cone shaped central reflector 302, according to one embodiment. In FIG. 3, the optical device 300 comprises a bowl shaped reflector base 304, an LED 306 physically attached to the bowl shaped reflector base 304, the hyperbolic cone shaped central reflector 302 formed above the LED 306 about a center of the bowl shaped reflector base 304, and a transparent plate 308 formed around a base of the hyperbolic cone shaped central reflector 302. Although it is not shown, in one exemplary implementation, the LED 306 is formed on top of the bowl shaped reflector base 304. In another exemplary implementation, as illustrated in FIG. 3, the LED 306 is formed in a hole which is formed at the center of the bowl shaped reflector base 304. The tip of the hyperbolic cone shaped central reflector 302 is either actually touching a top surface of the LED 306 or almost touching the top surface of the LED 306. In one embodiment, the hyperbolic cone shaped central reflector 302 is configured to reflect a portion of light emitted from the LED 306 to an outer edge of the bowl shaped reflector base 304 which in turn substantially reflects the portion of light via the transparent plate 308 almost parallel to an optical axis 310 of the LED 306.

In one exemplary implementation, the LED 306 is an LED chip. In one exemplary implementation, the bowl shaped reflector base 304 and the hyperbolic cone shaped central reflector 302 are made of a material that reflects light efficiently and/or essentially work as mirrors. In one exemplary implementation, the transparent plate 308 comprises a Fresnel lens 312 which forms an inner part of the transparent plate 308. In one exemplary implementation, a diameter 314 of the optical device 300 is more than 10 millimeters (e.g., about 20 millimeters) and a thickness 316 of the optical device 300 is about or less than 5 millimeters.

In one exemplary implementation, a part of beams of light emitted by the LED 306 are directly refracted through the Fresnel lens 312 of the transparent plate 308; a part of the beams of light emitted by the LED 306 are first reflected by the hyperbolic cone shaped central reflector 302 and by the bowl shaped reflector base 304, and then refracted through the Fresnel lens 312 of the transparent plate 308; and a part of the beams of light emitted by the LED 306 are first reflected by the hyperbolic cone shaped central reflector 302 and by the bowl shaped reflector base 304, and then refracted through an outer part of the transparent plate 308, which is not a part of the Fresnel lens 312. Thus, by implementing the hyperbolic cone shaped central reflector 312, the optical device 300 is able to collimate the beams of light emitted by the LED 306 over a wide cross section in a short distance away from the light source, i.e., the LED 306. The spreading of the beams of light over a wide cross section in short distance from the source of the light (e.g., the LED 306) may make it possible to fabricate an ultra slim optical device (e.g., the optical device 300) which can efficiently collimate the beams of lights emitted by the LED 306 over the wide cross section at high intensity.

FIG. 4*a* illustrates an exemplary three dimensional view 400 of the bowl shaped reflector base 304 in FIG. 3, according to one embodiment. In FIG. 4*a*, the bowl shaped reflector base 304 is a cylinder comprising a bottom surface 402 and a lateral surface 404. In one exemplary implementation, the bottom surface 402 is configured to function as a reflector, i.e., mirror. In one exemplary implementation, as illustrated in FIG. 3, a cross sectional view the lateral surface 404 comprises a bowl formed at an inner part of the lateral surface 404. Further, a central portion 406 represents an area at the bottom surface 402 where the LED 306 (e.g., an LED chip) may be implemented or mounted on. Alternatively, the central portion 406 represents a hole at the bottom surface 402 where the LED 306 may be placed in.

FIG. 4*b* illustrates an exemplary three dimensional view 410 of the transparent plate 308 in FIG. 3, according to one embodiment. In FIG. 4*b*, the transparent plate 308 comprises an inner surface 412 and an outer surface 414. In one exemplary implementation, the inner surface 412 is made of the Fresnel lens 312. In one exemplary implementation, the outer surface 414 of the transparent place 308 is made of a transparent material, which is not the Fresnel lens 312. Further, the transparent plate 308 comprises a hole 416 at the center of the transparent plate 308.

FIG. 4*c* illustrates an exemplary three dimensional view 420 of the bowl shaped reflector base 302 in FIG. 3, according to one embodiment. In FIG. 4*c*, the hyperbolic cone shaped central reflector 302 comprises a reflector tip 422, a reflector surface 424, a reflector base 426, and a reflector top 428. In one exemplary implementation, the axis of the hyperbolic cone shaped central reflector 302 coincides with the optical axis 310 of the LED 306. In addition, an angle 430 formed by the axis of the hyperbolic cone shaped central reflector 302 and the reflector surface 424 at the reflector tip 422 and/or an angle 432 formed by the axis of the hyperbolic cone shaped central reflector 302 and the reflector surface 424 at the reflector base 426 may be configured to generate collimated beams (e.g., the collimated beams 114) using the optical device 300 of a ultra slim thickness (e.g., about or less than 5 millimeters) when the diameter of the optical device 300 is more than 10 millimeters (e.g., about 20 millimeters).

FIG. 5*a* represents an exemplary view 500 illustrating a first path of beams collimated by the optical device 300 of FIG. 3, according to one embodiment. In FIG. 5*a*, beams of light 502 emitted by the LED 306 are reflected by the hyperbolic cone shaped central reflector 302 toward the outer edge of the bow shaped reflector base 304. As the beams of light 502 reflected off of the hyperbolic cone shaped central reflector 302 hit the slanted surface of the bowl shaped reflector base 304, the beams of light 502 are again reflected off of the surface towards the outer surface 414 of the transparent plate 308. The beams of light 502 are then refracted by the transparent plate 308 as collimated beams 504. It is appreciated that the collimated beams 504 may be parallel with the optical axis 310.

FIG. 5*b* represents an exemplary view 550 illustrating a second path of beams collimated by the optical device 300 of FIG. 3, according to one embodiment. In FIG. 5*b*, collimated beams 554 are formed by refraction and total internal reflection at the periodic structure of the Fresnel lens 312, which is formed at the inner surface of the transparent plate 308. In addition, there are rays that pass through the outer surface 414 and not deflected from their initial direction(s). It is appreciated that the collimated beams 554 may be parallel with the optical axis 310.

FIG. 6*a* illustrates an exemplary view 600 of an indicatrix 602 of the collimated beams 504 in FIG. 5*a*. FIG. 5*a* illustrates the path of rays or beams of light which go through the outer surface 414 of the transparent plate 308. As illustrated in the indicatrix 602, the solution may allow effectively collimating part of the beams emitted by the LED 306 with beam divergence at 0.5 level around 12 degrees and the total intensity near 30.17%. It is appreciated that the beam divergence is an angular measurement of the increase in beam diameter or radius with distance from the optical aperture from which the beam emerges. The divergence of a beam may be calculated if one knows the beam diameter at two separate points, and the distance between these points. Further, if the beam has been collimated using a lens or other focusing element, the divergence expected may be calculated from the diameter of the narrowest point on the beam before the lens and the focal length of the lens.

FIG. 6*b* illustrates an exemplary view 610 of an indicatrix 612 of the collimated beams 554 in FIG. 5*b*. FIG. 5*b* illustrates the path of rays or beams of light which go through the inner surface 412 of the transparent plate 308. As illustrated in the indicatrix 612, the solution may allow effectively collimating part of the beams emitted by the LED 306 with beam divergence at 0.5 level around 33 degrees and the total intensity near 63.51%. FIG. 6*c* illustrates an exemplary view 620 of an indicatrix 622 of the beams collimated by the optical device 300 in FIG. 3. As illustrated in the indicatrix 622, the solution may allow effectively collimating the beams emitted by the LED 306 with beam divergence at 0.5 level around 14 degrees and the total intensity near 93.68%.

The various devices, modules, analyzers, generators, etc. described herein may be enabled and operated using hardware circuitry (e.g., complementary metal-oxide-semiconductor (CMOS) based logic circuitry), firmware, software and/or any combination of hardware, firmware, and/or software (e.g., embodied in a machine readable medium). Further, the various electrical structure and methods may be embodied using transistors, logic gates, and/or electrical circuits (e.g., application specific integrated circuit (ASIC)). Although the present embodiments have been described with reference to specific example embodiments, it will be evident that various modifications and changes may be made to these embodiments without departing from the broader spirit and scope of the various embodiments.

The invention claimed is:

1. An optical device, comprising:

a bowl shaped reflector base;

a light emitting diode (LED) physically attached to the bowl shaped reflector base;

a hyperbolic cone shaped central reflector formed above the LED, wherein the hyperbolic cone shaped central reflector comprises a reflector tip, a reflector surface, a reflector base, and a reflector top; and a transparent plate formed around the reflector base of the hyperbolic cone shaped central reflector, wherein the transparent plate comprises a Fresnel lens formed on an inner part of the transparent plate, wherein the hyperbolic cone shaped central reflector is configured to reflect a first part of beams of light emitted by the LED refracted through the Fresnel lens, and reflect a second part of the beams of light emitted by the LED refracted through an outer part of the transparent plate, which is not a part of the Fresnel lens, and wherein a remaining part of the beams of light emitted by the LED is directly refracted through the Fresnel lens of the transparent plate.

2. The optical device of claim 1, wherein a thickness of the optical device is about 5 millimeters.

3. The optical device of claim 2, wherein a diameter of the optical device is about 20 millimeters.

4. The optical device of claim 2, wherein a diameter of the optical device is more than 10 millimeters.

* * * * *